United States Patent [19]

Tsai

[11] Patent Number: 5,062,536

[45] Date of Patent: Nov. 5, 1991

[54] ROTATABLE HANGER ASSEMBLY

[75] Inventor: Huang S. Tsai, Taichung Hsien, Taiwan

[73] Assignees: Tung Keng Col, Ltd., Taichung Hsien, Taiwan; Tung Keng Col, Ltd., Taichung Hsien, Taiwan

[21] Appl. No.: 613,593

[22] Filed: Nov. 15, 1990

[51] Int. Cl.[5] ..... A47F 5/00

[52] U.S. Cl. ..... 211/162; 211/122

[58] Field of Search ..... 211/113, 115, 122, 162

[56] References Cited

U.S. PATENT DOCUMENTS

| | | | |
|---|---|---|---|
| 643,818 | 2/1900 | Headland | 211/113 |
| 869,233 | 10/1907 | Dracker | 211/113 X |
| 950,006 | 2/1910 | McCarty | 211/162 |
| 3,139,191 | 6/1964 | King | 211/122 |
| 3,162,417 | 12/1964 | Briggs | 211/162 X |
| 3,780,852 | 12/1973 | Weiss et al. | 211/122 |

*Primary Examiner*—Carl D. Friedman
*Assistant Examiner*—Korie H. Chan
*Attorney, Agent, or Firm*—Townsend and Townsend; Townsend and Townsend

[57] ABSTRACT

A hanger device includes a base and an upper support coupled together by two posts. A lower track is disposed on the base. The upper support has an upper track disposed in parallel to the lower track. A number of frames each has an upper portion slidably coupled to the upper track by two roller supports and has a lower portion slidably coupled to the lower track by two guides. A bar is laterally coupled to an upper portion of each frame. The frames are pivotally coupled together so that the frames move in concert along the tracks. The clothes hung on the bars can be easily reached when the frames are rotated.

3 Claims, 5 Drawing Sheets

ROTATABLE HANGER ASSEMBLY

BACKGROUND OF THE INVENTION

The present invention relates to a hanger assembly, and more particularly to a rotatable hanger assembly.

Normally, a rod is laterally provided on an upper portion of a closet or a wardrobe so that clothes may be hung on the rod. Since there is only one rod provided therein, only a few clothes can be hung on the rod so that a large space in the closet is left unused.

The present invention has arisen to mitigate and/or obviate the afore-described disadvantages of the conventional hanger assembly.

SUMMARY OF THE INVENTION

The primary objective of the present invention is to provide a rotatable hanger assembly on which many clothes can be hung and the clothes can be easily reached.

In accordance with one aspect of the invention, there is provided a hanger device which includes a base and an upper support coupled together by two posts. A lower track which is endless is disposed on the base. The upper support has an upper track which has a shape similar to that of the lower track and which is disposed in parallel to the lower track. A number of frames each has an upper portion slidably coupled to the upper track by two roller supports and has a lower portion slidably coupled to the lower track by two guides. A bar is laterally coupled to an upper portion of each of the frames so that clothes may be hung on the bar. Every two adjacent frames are pivotally coupled together by one or more strips so that the frames move in concert along the lower track and the upper track and so that a great many clothes can be hung on either of the bars and can be easily reached.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
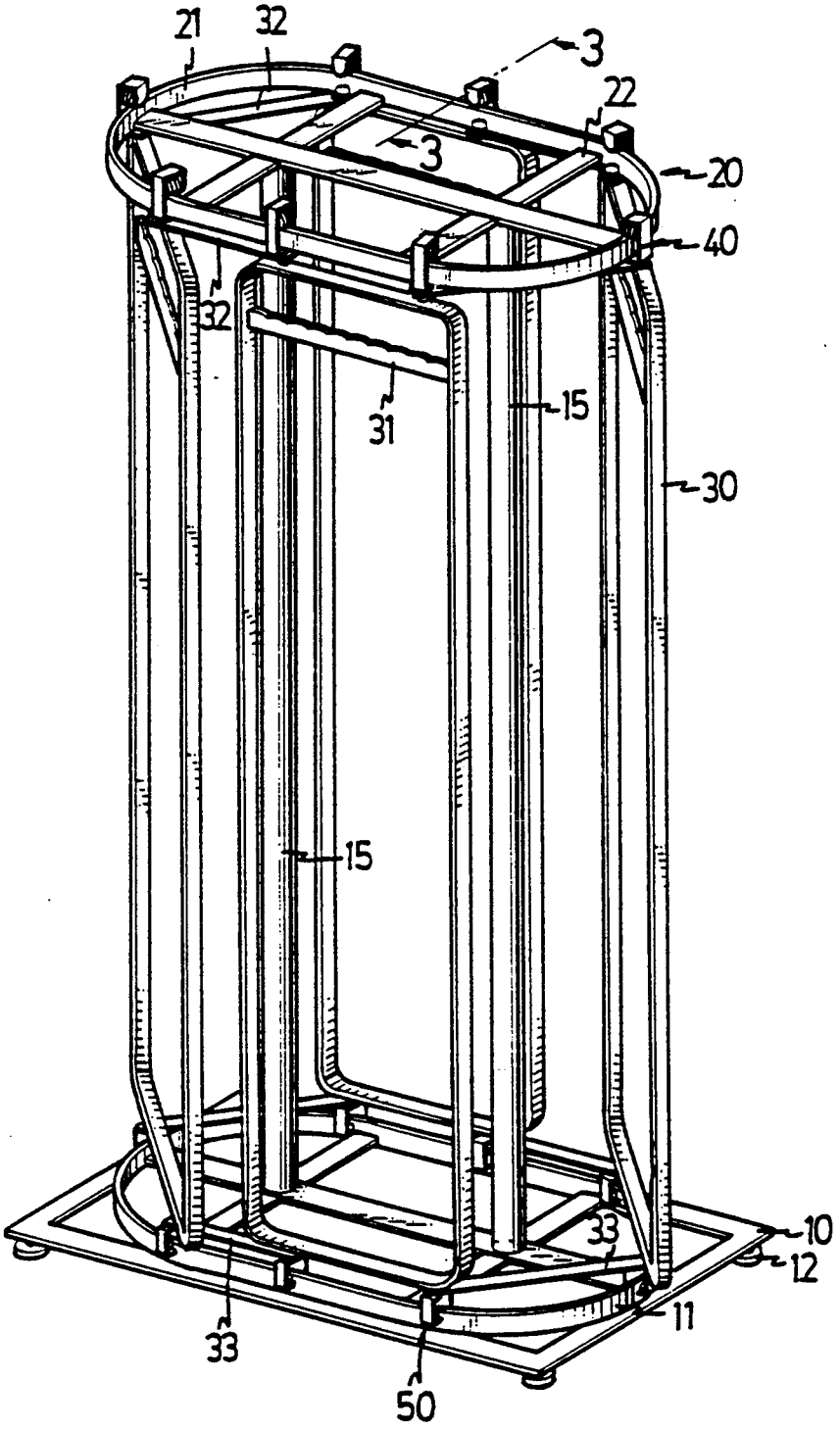
FIG. 1 is a perspective view of a rotatable hanger assembly in accordance with the present invention.

Referring to the drawings and initially to FIG. 1, the rotatable hanger assembly in accordance with the present invention comprises generally a plurality of frames 30 rotatably supported between a base 10 and an upper support 20 which are coupled together by two posts 15.

A pad 12 or the like is provided on each of the four corner areas of the bottom of the base 10. A lower track 11 which is endless and which is elliptical is disposed upon the base 10. The upper support 20 includes an upper track 21 which is preferably identical to the lower track 11, and several reinforced elements 22 coupled in the upper track 21. The posts 15 are fixed between the base 10 and the reinforced elements 22 of the upper support 20. The lower track 11 and the upper track 21 are preferably arranged in parallel with each other.

As shown in the drawings, there are four frames 30 provided between the upper support 20 and the base 10. Each of the frames 30 is substantially rectangular with a bar 31 laterally provided in an upper portion thereof so that clothes can be hung on the bar 31. The upper portion and the lower portion of each of the frames 30 are slidably coupled to the upper track 21 and the lower track 11 by two roller supports 40 and two guides 50 respectively so that the frames 30 are slidable along the upper track 21 and the lower track 11. An upper strip 32 is pivotally coupled between the two adjacent roller supports 40 of every two adjacent frames 30, and a lower strip 33 is pivotally coupled between the two adjacent guides 50 of every two adjacent frames 30 so that the frames 30 are pivotally coupled together by the strips 32, 33 and so that the frames 30 move in concert along the tracks 11, 21. A great many clothes can be hung on either of the four bars 31 of the frames 30.

Figure 2:
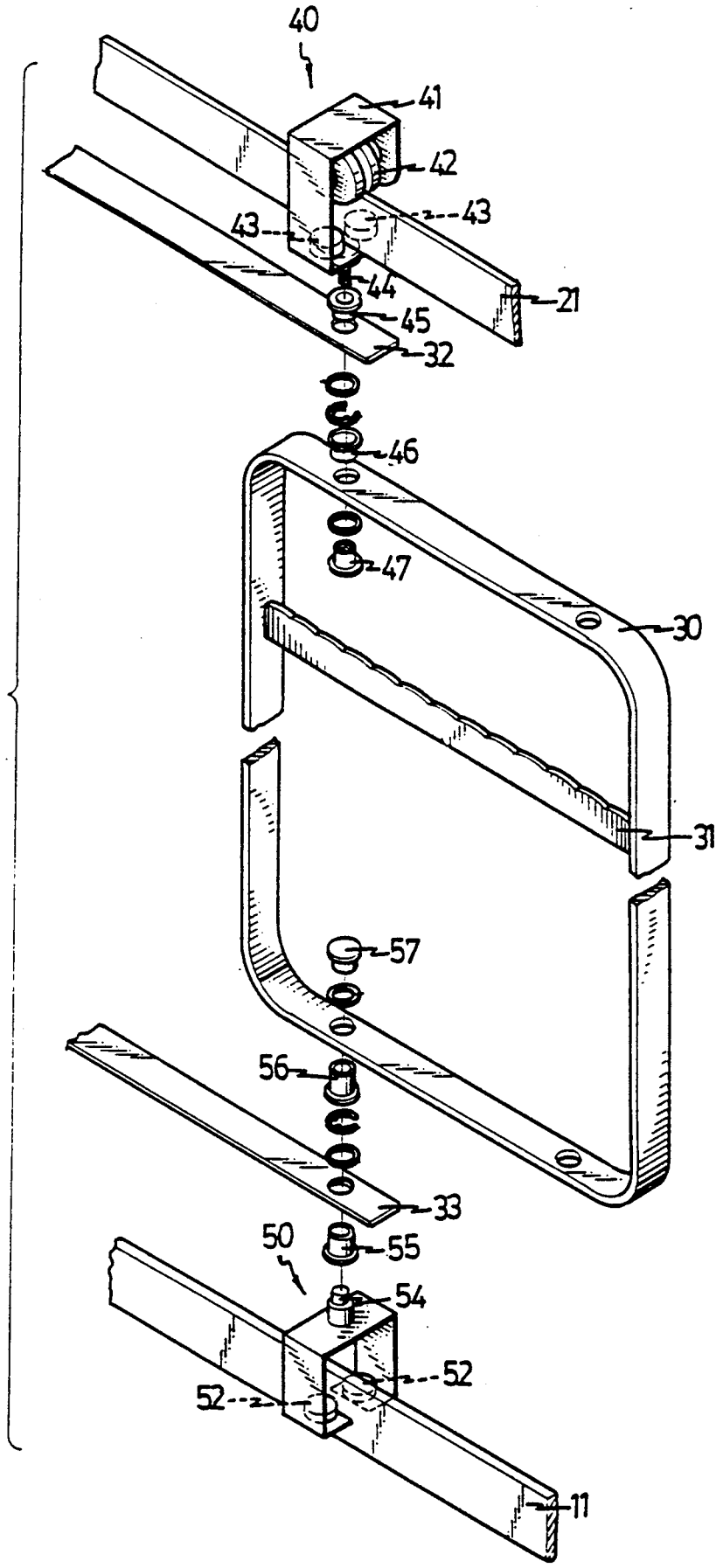
FIG. 2 is a partial exploded view of the frame of the rotatable hanger assembly.
Figure 3:
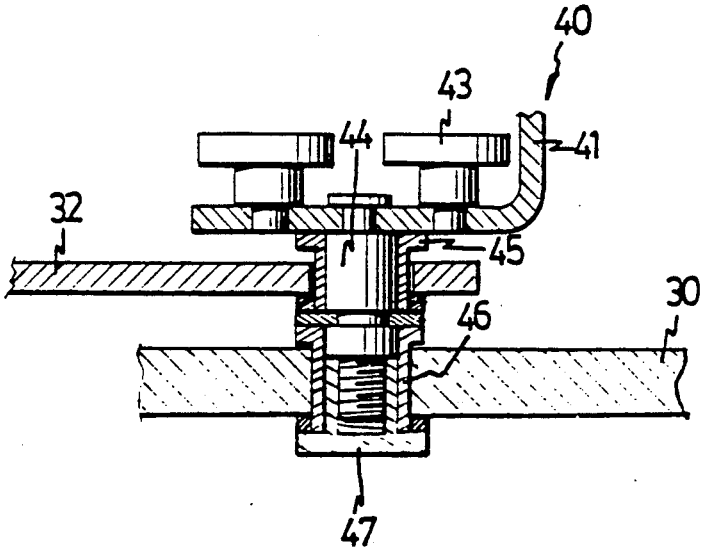
FIG. 3 is a cross sectional view taken along lines 3—3 of FIG. 1.

Referring next to FIGS. 2 and 3, each roller support 40 includes a substantially C-shaped holder 41 with a roller 42 provided in the upper portion of the holder 41 and with a pair of discs 43 provided in the lower portion of the holder 41. The roller 42 is straddled on the upper track 21 so that the roller support 40 can slide freely along the upper track 21. The discs 43 are pivotally supported on the bottom of the holder 41 and slidably contact the side surfaces of the upper track 21 so that the roller support 40 can stably slide along the upper track 21. A bolt 44 is fixed to the lower surface of the holder 41 and extends downward. Two sleeves 45, 46 are engaged to the bolt 44 and a sleeve nut 47 is threadedly engaged to the lower end of the bolt 44 so that the sleeves 45, 46 are rotatably supported on the bolt 44 by the sleeve nut 47. The end portion of the upper strip 32 is rotatably coupled to the sleeve 45, and one side of an upper wall of each of the frames 30 is rotatably coupled to the sleeve 46 so that the upper strip 32 and the frame 30 can be pivotally coupled to the roller support 40.

Each of the guides 50 includes an inverted U-shaped holder 51 with two discs 52 rotatably provided in the lower portion thereof. The discs 52 are pivotally supported on the bottom of the holder 51 and slidably contact the side surfaces of the lower track 11 so that the guide 50 is guided to slide along the lower track 11. A bolt 54 is fixed on the upper surface of the holder 51 and extends upward. Two sleeves 55, 56 are engaged on the bolt 54 and a sleeve nut 57 is threadedly engaged to the upper end of the bolt 54 so that the sleeves 55, 56 are rotatably supported on the bolt 54 by the sleeve nut 57. The end portion of the lower strip 33 is rotatably coupled to the sleeve 55, and one side of a lower wall of each of the frames 30 is rotatably coupled to the sleeve 56 so that the lower strip 33 and the frame 30 can be pivotally coupled to the guide 50.

Figure 4:
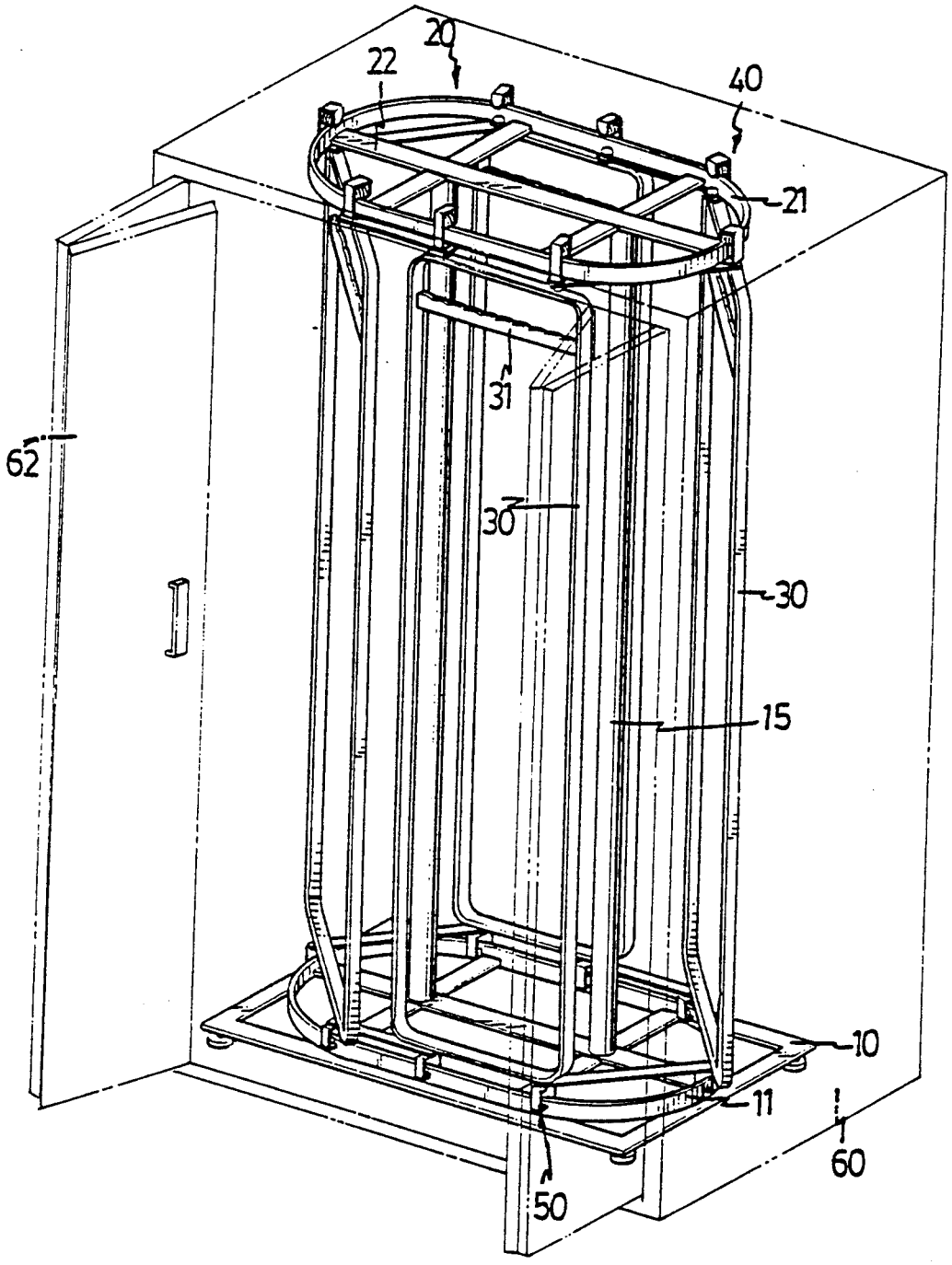
FIGS. 4 and 5 are perspective views embodying the present invention.

Referring next to FIG. 4, the rotatable hanger assembly in accordance with the present invention can be disposed within a closet 60 which has two wide open doors 62 shown in an open state. The frames 30 can be rotated so that the clothes hung on the frame located in the inner side of the closet 60 can be easily reached.

Figure 5:
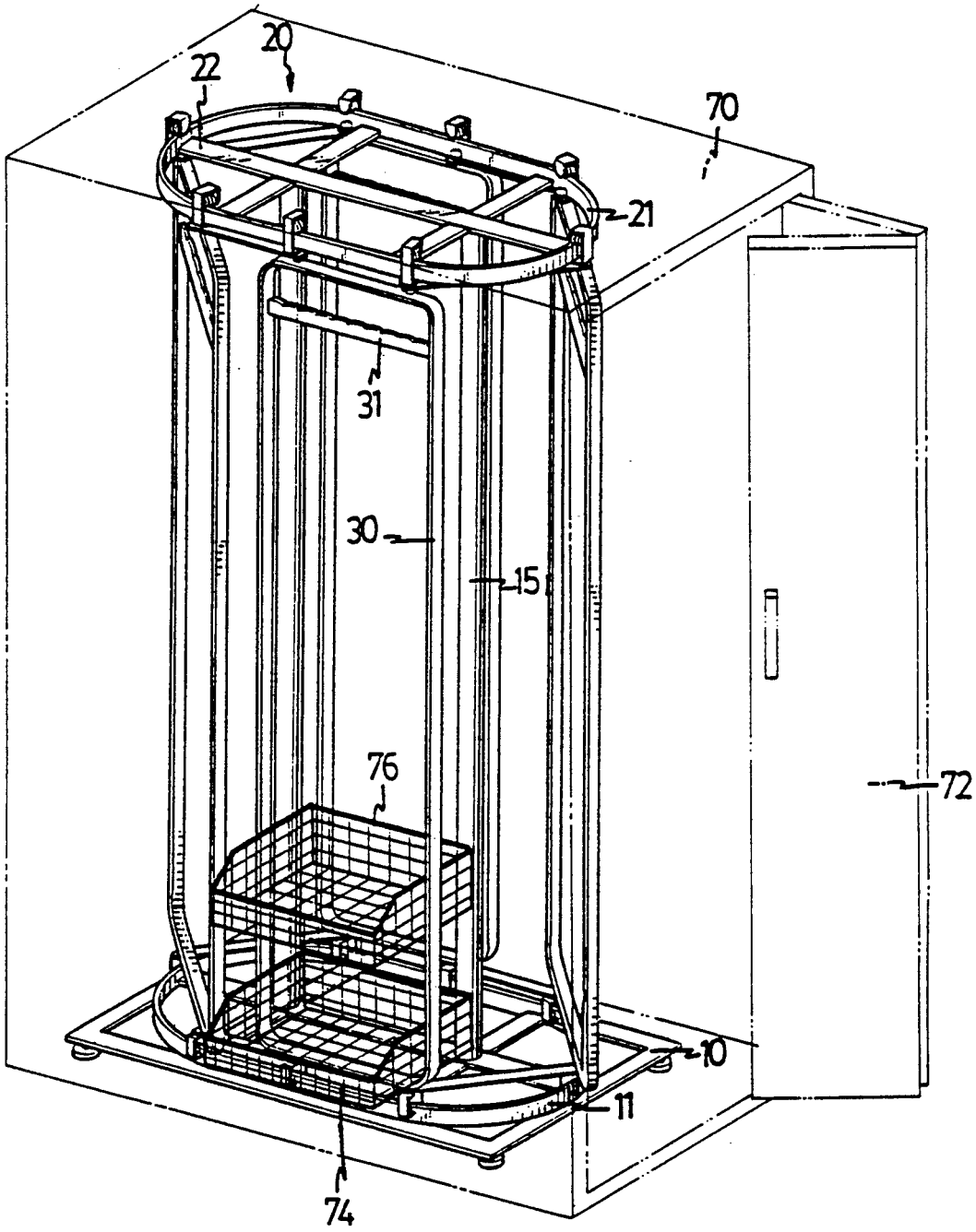

Referring next to FIG. 5, the rotatable hanger assembly can also be disposed within a closet 70 which has a door 72 provided on the narrower side. When a required clothes is hung on the inner side of the frame 30, it is only require to rotate the frames 30 so that the frame 30 on which the required clothes is hung can be rotated to the door side. The user does not need to enter into the closet 70 to find the clothes. Optionally, two baskets 74, 76 can be fixed in the lower portion of the frame 30 in order to support other objects.

Alternatively, each of the pads 12 can be replaced by a wheel (not shown) so that the rotatable hanger assembly can be easily moved.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A hanger assembly comprising a base and an upper support coupled together by two posts, a first track which is endless being disposed on said base and having two side surfaces, said upper support having a second track which has a shape similar to that of said first track and which is disposed in parallel to said first track and which has two side surfaces, a plurality of frames, an upper portion of each of said frames being slidably coupled to said second track by two roller supports, each of said roller supports including a substantially C-shaped holder with a roller provided in an upper portion of said holder and with a pair of discs pivotally supported on a lower portion of said holder, said roller being straddled on said second track so that said roller support can slide freely along said second track, said discs slidably contacting said side surfaces of said second track so that said upper portion of said frame can be guided to slide along said second track, a lower portion of each of said frames being slidably coupled to said first track by two guides, a bar being laterally coupled to an upper portion of each of said frames so that clothes may be hung on said bar, an upper strip being pivotally coupled between two adjacent roller supports of every two adjacent frames, and a lower strip being pivotally coupled between two adjacent guides of every two adjacent frames so that said frames are pivotally coupled together by said strips and so that said frames move in concert along said first track and said second track and so that a great many clothes can be hung on either of said bars, and said clothes can be easily reached when said frames are rotated to slide along said first track and said second track.

2. A hanger assembly according to claim 1, wherein a bolt is fixed to a lower surface of said holder and extends downward, two sleeves are engaged to said bolt and a sleeve nut is threadedly engaged to a lower end of said bolt so that said sleeves are rotatably supported on said bolt by said sleeve nut, an end portion of said upper strip is rotatably coupled to one of said sleeves, and another sleeve is rotatably coupled in one side portion of said upper portion of each of said frames so that said upper strip and said frame can be pivotally coupled to said roller support.

3. A hanger assembly comprising a base and an upper support coupled together by two posts, a first track which is endless being disposed on said base and having two side surfaces, said upper support having a second track which has a shape similar to that of said first track and which is disposed in parallel to said first track and which has two side surfaces, a plurality of frames, an upper portion of each of said frames being slidably coupled to said second track by two roller supports, a lower portion of each of said frames being slidably coupled to said first track by two guides, each of said guides including an inverted U-shaped holder with two discs pivotally supported on a lower portion of said holder and slidably contact said side surfaces of said first track so that said guides are guided to slide along said first track, a bolt being fixed on an upper surface of said holder and extending upward, two sleeves being engaged on said bolt and a sleeve nut being threadedly engaged to an upper end of said bolt so that said sleeves are rotatably supported on said bolt by said sleeve nut, a bar being laterally coupled to an upper portion of each of said frames so that clothes may be hung on said bar, an upper strip being pivotally coupled between two adjacent roller supports of every two adjacent frames, and a lower strip being pivotally coupled between two adjacent guides of every two adjacent frames so that said frames are pivotally coupled together by said strips and so that said frames move in concert along said first track and said second track and so that a great many clothes can be hung on either of said bars, an end portion of each of said lower strips being rotatably coupled to one of said sleeves, another sleeve being rotatably coupled in one side of said lower portion of each of said frames so that said lower strips and said frames can be pivotally coupled to said guide, and said clothes can be easily reached when said frames are rotated to slide along said first track and said second track.

* * * * *